US005979436A

United States Patent [19]

Chiang et al.

[11] Patent Number: 5,979,436

[45] Date of Patent: Nov. 9, 1999

[54] SMOKE EXHAUSTER HAVING PERIPHERAL AIR DRAWING EFFECT

[76] Inventors: Chao Cheng Chiang; Chi Shyong Chiang, both of P.O. Box 63-151, Taichung, Taiwan, 406

[21] Appl. No.: 09/197,558

[22] Filed: Nov. 23, 1998

[51] Int. Cl.[6] ..... F24C 15/20

[52] U.S. Cl. ..... 126/299 D; 126/299 R

[58] Field of Search ..... 126/299 D, 299 R, 126/299 F; 454/66, 341; 55/DIG. 36

[56] References Cited

U.S. PATENT DOCUMENTS 4,500,331 2/1985 Cheng ..... 126/299 D
5,228,428 7/1993 Jang ..... 126/299 D
5,372,122 12/1994 Hong et al. ..... 126/299 D
5,537,988 7/1996 Lin ..... 126/299 D

*Primary Examiner*—Ira S. Lazarus
*Assistant Examiner*—Sara Clarke

[57] ABSTRACT

A smoke exhauster includes one or more drawing devices secured in a hood for drawing a smoke. A plate is secured to the bottom of the hood and has one or more holes aligned with the drawing devices and has a number of slots formed in the peripheral portion. A casing is disposed on the plate and has a number of grooves formed in the lower peripheral portion for allowing the smoke in the peripheral portion of the plate to be drawn into the casing and for allowing the smoke to be effectively drawn out by the smoke exhauster.

5 Claims, 5 Drawing Sheets

SMOKE EXHAUSTER HAVING PERIPHERAL AIR DRAWING EFFECT

BACKGROUND OF THE INVENTION

1. Field of the Invention

The present invention relates to a smoke exhauster, and more particularly to a smoke exhauster having a peripheral air drawing mechanism.

2. Description of the Prior Art

Typical smoke exhausters comprise one or two openings formed in the bottom and one or more fans for drawing the air or smoke through the openings. However, a portion of the air or smoke will not be drawn through the openings and may also flow bypass the smoke exhauster. Some of the smoke exhausters includes a chute directed to the rear portion of the smoke exhauster for drawing the smoke flowing to the rear portion of the smoke exhauster. However, the smoke flowing to the front portion and the side portions of the smoke exhauster may also not be drain out through the openings.

The present invention has arisen to mitigate and/or obviate the afore-described disadvantages of the conventional smoke exhausters.

SUMMARY OF THE INVENTION

The primary objective of the present invention is to provide a smoke exhauster having a mechanism for drawing the smoke in the peripheral portion of the smoke exhauster.

In accordance with one aspect of the invention, there is provided a smoke exhauster comprising a hood including a bottom portion, at least one drawing device secured in the hood for drawing a smoke, a plate secured to the bottom portion of the hood, the plate including at least one hole formed therein and aligned with the drawing device and including a peripheral portion having a plurality of slots formed therein, and a casing disposed on the plate and including a frame and a cover disposed on the frame for forming a chamber between the frame and the cover, the frame including at least one aperture formed therein and aligned with the hole of the plate and including a peripheral portion having a plurality of grooves formed therein and aligned with the slots of the plate for allowing the smoke to be drawn into the chamber of the casing from the peripheral portion of the plate, the cover including at least one puncture formed therein and aligned with the drawing device, the puncture of the cover including a size greater than that of the aperture of the frame and the hole of the plate for allowing the smoke in the chamber to be drawn through the puncture of the cover by the drawing device.

The cover includes a peripheral inclined panel disposed above the grooves of the frame and the slots of the plate for preventing oil from draining downward through the grooves of the frame and the slots of the plate.

The grooves of the frame each is defined by an upwardly extended peripheral fence for preventing an oil from flowing downward through the grooves.

The hood includes a housing secured therein for enclosing the drawing device, the housing includes at least one opening formed therein and aligned with the puncture of the cover. At least one trap is further secured to the housing and has an orifice defined by an upwardly extended flange and aligned with the opening of the housing, the frame includes a flange extended upwardly and radially inwardly from the frame for defining the aperture of the frame, the flange of the frame includes a size smaller than that of the flange of the trap for forming a gap between the flange of the frame and the flange of the trap.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
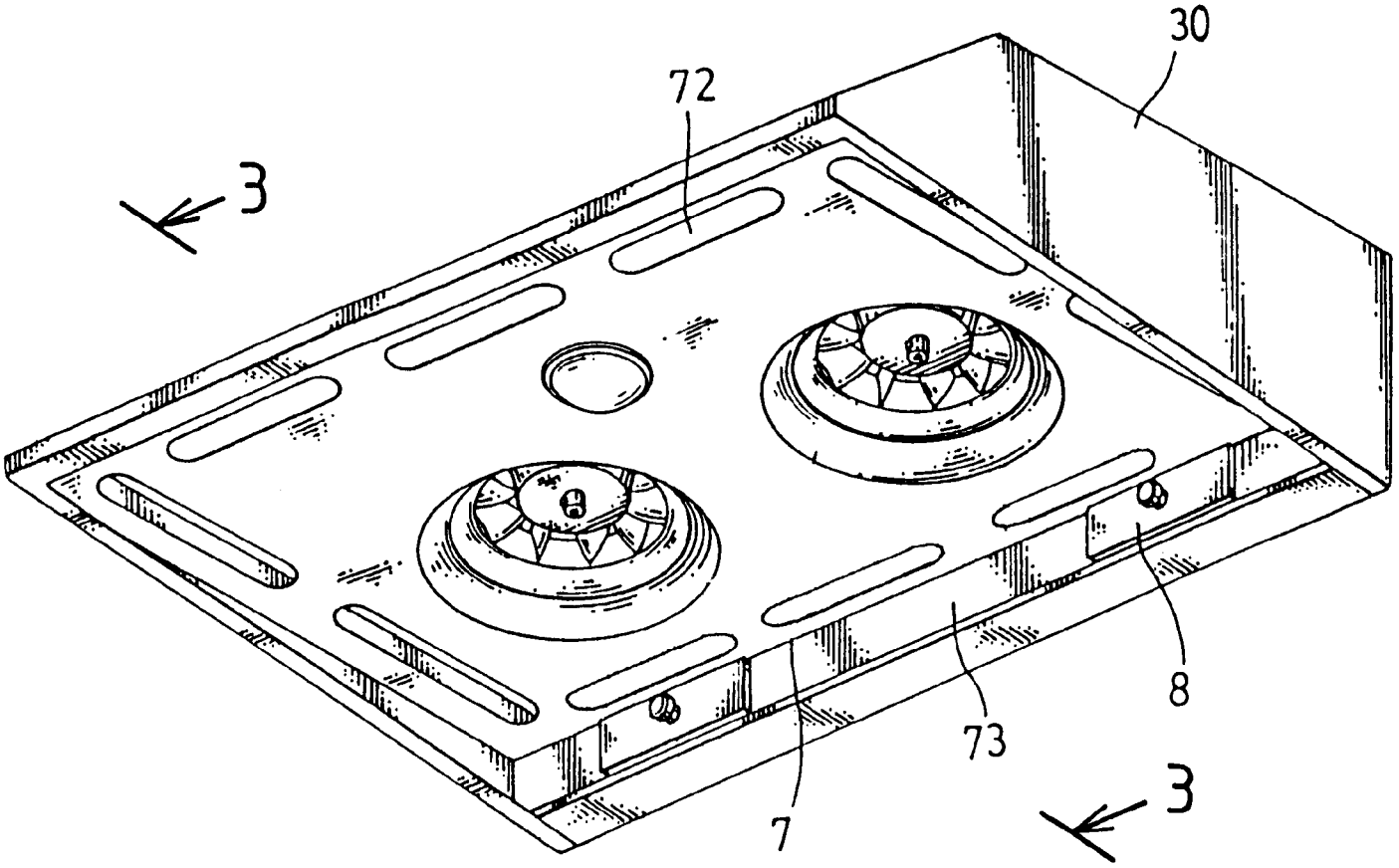
FIG. 1 is a perspective view of a smoke exhauster in accordance with the present invention.
Figure 2:
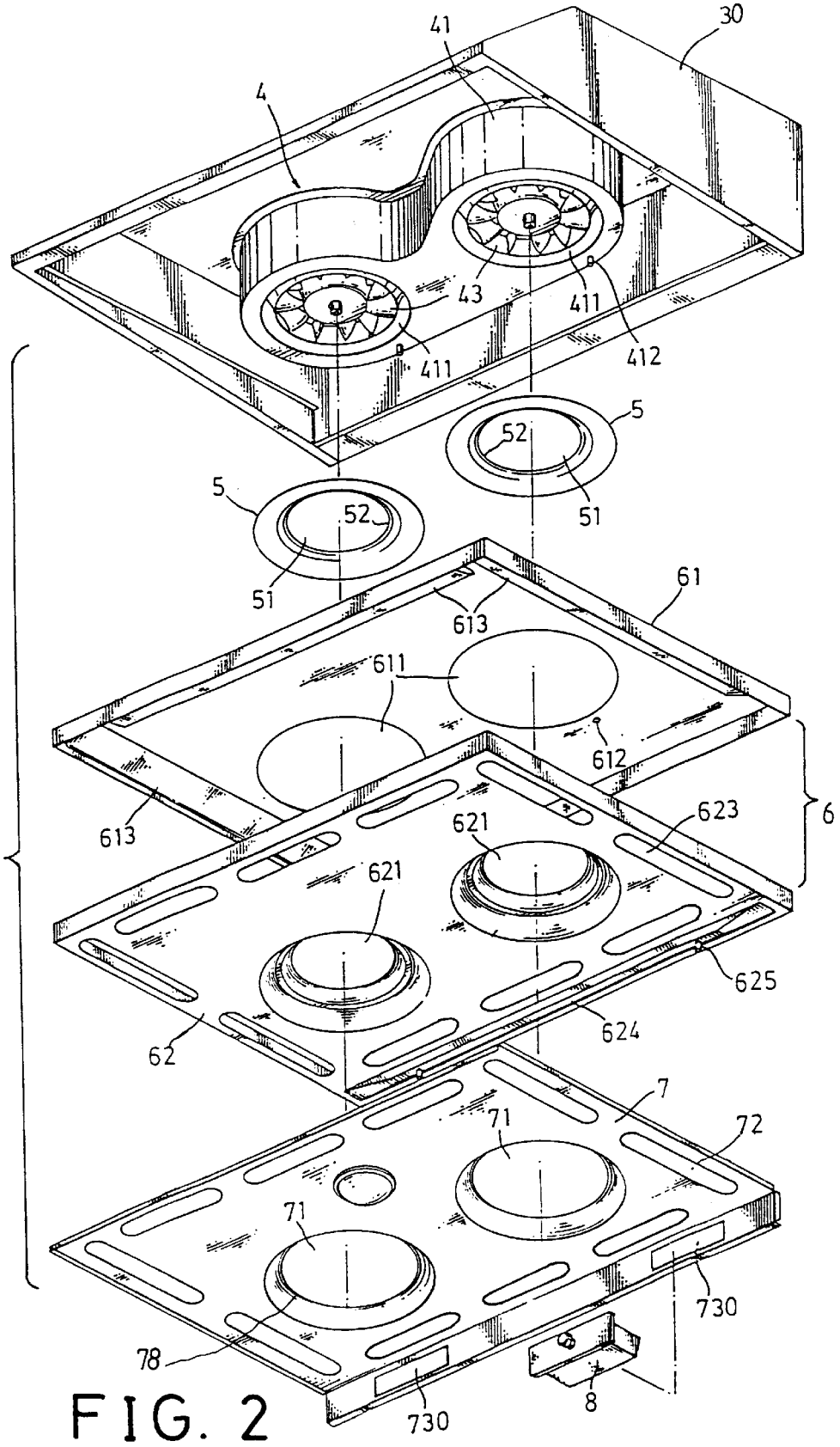
FIG. 2 is an exploded view of the smoke exhauster.
Figure 3:
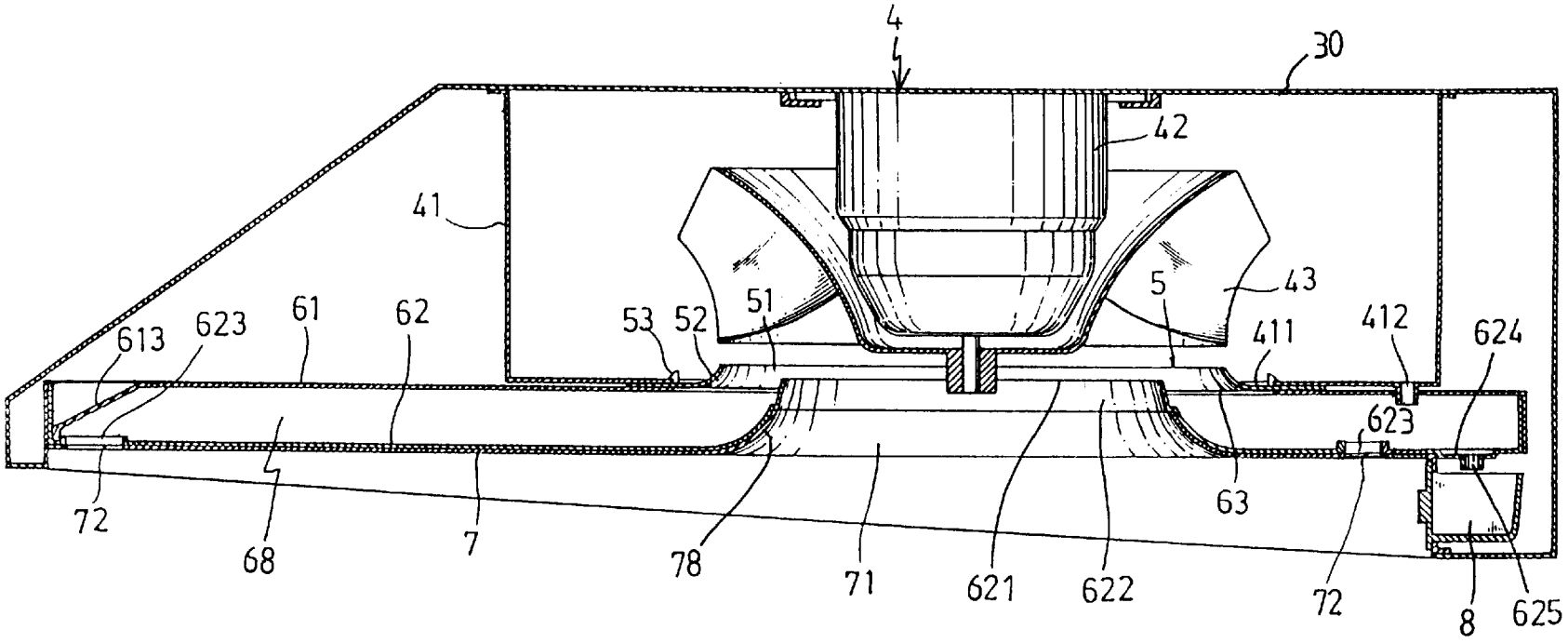
FIG. 3 is a cross sectional view taken along lines 3—3 of FIG. 1.

Referring to the drawings, and initially to FIGS. 1–3, a smoke exhauster in accordance with the present invention comprises a hood 30, one or more drawing devices 4 each including a motor 42 secured in the hood 30 and a fan 43 secured to the motor 42 so as to be driven by the motor 42. It is preferable that a housing 41 is secured to the hood 30 for enclosing the motors 42 and includes one or more openings 411 aligned with the fans 43 for exposing the fans 43 and for allowing the fans 43 to draw the smoke through the openings 411. The housing 41 includes one or more ports 412 provided in the rear and bottom portion for oil draining purposes. One or more traps 5 each includes a number of hooks 53 (FIG. 3) for attaching onto the housing 41 and each includes a center orifice 51 formed therein and defined by an upwardly and partially radially and inwardly extended flange 52 for determining the size of the smoke flowing passage.

A casing 6 includes a cover 61 disposed on a frame 62. The cover 61 includes one or more punctures 611 aligned with the traps 5 and the openings 411 of the housing 41 and includes one or more holes 612 for receiving the ports 412 of the housing 41 and includes a peripheral inclined panel 613 for guiding the collected oil to flow downward along the inclined panel 613 (FIGS. 2–5). The frame 62 is to be attached to the bottom portion of the cover 61 for forming a chamber 68 between the frame 62 and the cover 61 (FIG. 3), and includes one or more apertures 621 each defined by a flange 622 that is extended upwardly and radially inwardly. As best shown in FIG. 3, the aperture 621 of the flange 622 has a size smaller than that of the orifice 51 of the flange 52 such that a gap 63 is formed between the flanges 52, 622 for allowing the smoke in the chamber 68 to be drawn through the gap 63 and the openings 411 of the housing 41. The frame 62 includes a number of grooves 623 formed in the peripheral portion for forming a smoke passage and located below the inclined panel 613 (FIGS. 3, 5). The frame 62 includes a recess 624 (FIG. 3) formed in the rear portion for collecting the oil that may be formed and collected from the smoke, and includes one or more exits 625 communicating with the recess 624 for draining the collected oil in the recess 624.

A plate 7 is secured in the bottom portion of the hood 30 by such as fasteners and includes one or more holes 71 each defined by a flange 78 that is extended upwardly and radially inwardly. The plate 7 includes a number of slots 72 formed in the peripheral portion and aligned with the grooves 623 of the frame 62 and located below the inclined panel 613 (FIGS. 3, 5) for forming the smoke passage and for allowing the smoke to be drawn into the chamber 68 of the casing 6 and to be drawn through the orifices 51 of the traps 5. The plate 7 includes a wall 73 extended downward from the rear portion and having one or more cavities 730 formed therein for receiving the oil collecting cups 8 which are disposed below the exits 625 of the frame 62 for collecting the oil. The plate 7 may support the frame 62 and the cover 61 of the casing 6 in place such that the casing 6 is not required to be secured to the hood 30 or the housing 4 by fasteners.

Figure 5:
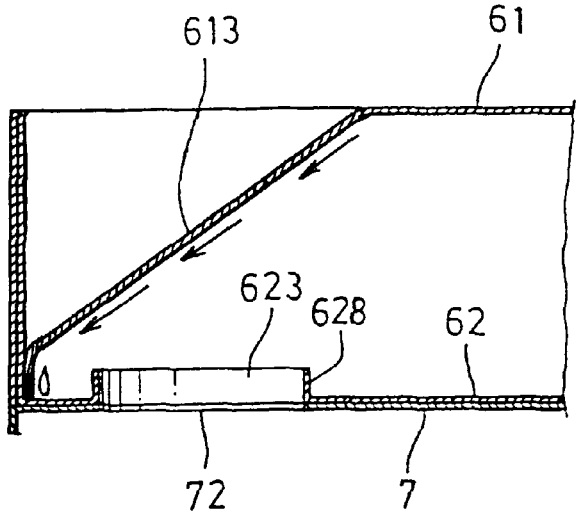
FIGS. 5 and 6 are enlarged partial cross sectional views illustrating two applications of the collected oil guiding mechanism.
Figure 6:
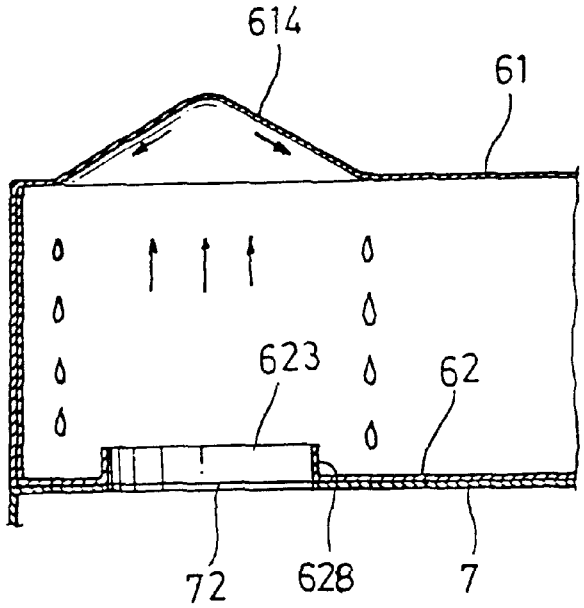

Referring next to FIG. 5, it is preferable that the grooves 623 of the frame 62 are each defined by an upwardly extended peripheral fence 628 for preventing the oil from flowing out through the grooves 623. As shown in FIG. 6, the inclined panel 613 of the cover 61 may be replaced by a pair of opposite and downwardly extended panels 614 for preventing the oil from flowing downward through the grooves 623.

Figure 4:
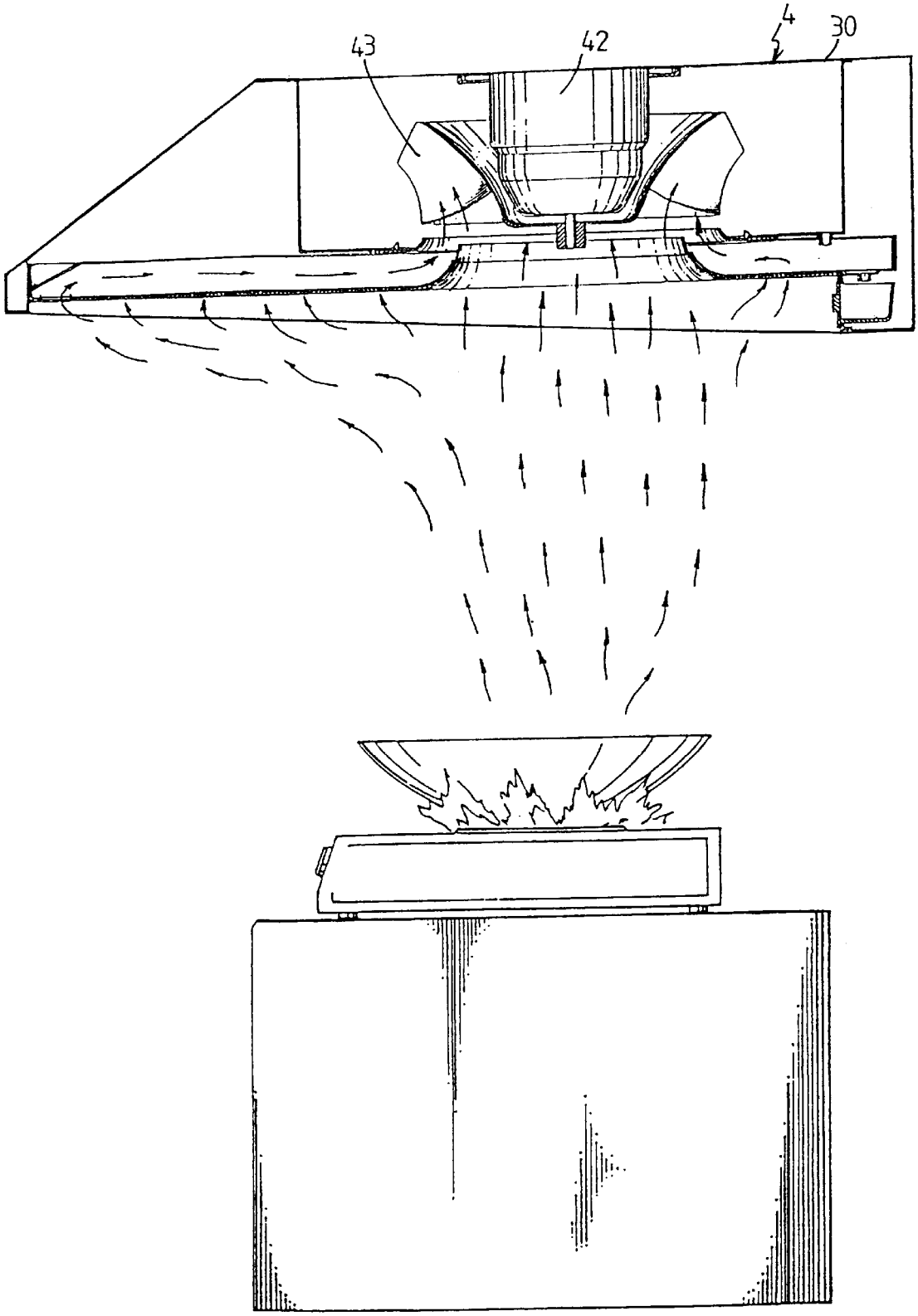
FIG. 4 is a schematic view illustrating the operation of the smoke exhauster.

In operation, as shown in FIG. 4, the smoke may be directly drawn through the holes 71 of the plate 7 and the apertures 621 of the frame 62, and then drawn out through the openings 411 of the housing 41. The smoke that has not be drawn through the holes 71 of the plate 7 may also be drawn into the chamber 68 of the casing 6 via the slots 72 of the plate 7 and the grooves 623 of the frame 62 and then may also be drawn out through the openings 411 of the housing 41. It is to be noted that the casing 6 including the frame 62 and the cover 61 may be easily formed and may be easily disposed on the plate 7 without been secured in place by fasteners. The engagement of the ports 412 into the holes 612 of the cover 61 may positively position the casing 6 in place.

Accordingly, the smoke exhauster in accordance with the present invention includes a mechanism for drawing the smoke in the peripheral portion of the smoke exhauster.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A smoke exhauster comprising:

a hood including a bottom portion, at least one drawing device secured in said hood for drawing smoke, a plate secured to said bottom portion of said hood, said plate including at least one hole formed therein and aligned with said at least one drawing device and including a peripheral portion having a plurality of slots formed therein, and a casing disposed on said plate and including a frame and a cover disposed on said frame for forming a chamber between said frame and said cover, said frame including at least one aperture formed therein and aligned with said at least one hole of said plate and including a peripheral portion having a plurality of grooves formed therein and aligned with said slots of said plate for allowing the smoke to be drawn into said chamber of said casing from said peripheral portion of said plate, said cover including at least one puncture formed therein and aligned with said at least one drawing device, said at least one puncture of said cover including a size greater than that of said at least one aperture of said frame and said at least one hole of said plate for allowing the smoke in said chamber to be drawn through said at least one puncture of said cover by said at least one drawing device.

2. The smoke exhauster according to claim 1, wherein said cover includes a peripheral inclined panel disposed above said grooves of said frame and said slots of said plate for preventing oil from draining downward through said grooves of said frame and said slots of said plate.

3. The smoke exhauster according to claim 1, wherein said grooves of said frame each is defined by an upwardly extended peripheral fence for preventing an oil from flowing downward through said grooves.

4. The smoke exhauster according to claim 1, wherein said hood includes a housing secured therein for enclosing said at least one drawing device, said housing includes at least one opening formed therein and aligned with said at least one puncture of said cover.

5. The smoke exhauster according to claim 4 further comprising at least one trap secured to said housing and having an orifice defined by an upwardly extended flange and aligned with said at least one opening of said housing, said frame including a flange extended upwardly and radially inwardly from said frame for defining said at least one aperture of said frame, said flange of said frame including a size smaller than that of said flange of said at least one trap for forming a gap between said flange of said frame and said flange of said at least one trap.

* * * * *